US005333551A

United States Patent [19]

Heitmann et al.

[11] Patent Number: 5,333,551

[45] Date of Patent: Aug. 2, 1994

[54] DRIVE MEMBER FOR A LARGE-CALIBER MULTI-PURPOSE CARTRIDGE AND USE OF SUCH A DRIVE MEMBER FOR THE PRODUCT OF DIFFERENT TYPES OF CARTRIDGES

[75] Inventors: Thomas Heitmann, Düsseldorf; Jürgen Böcker, Oberhausen; Ulf Hahn, Ratingen-Hösel, all of Fed. Rep. of Germany

[73] Assignee: Rheinmetall GmbH, Ratingen, Fed. Rep. of Germany

[21] Appl. No.: 10,813

[22] Filed: Jan. 29, 1993

[30] Foreign Application Priority Data

Jan. 31, 1992 [DE] Fed. Rep. of Germany ..... 4202780

[51] Int. Cl.[5] ..... F42B 5/02

[52] U.S. Cl. ..... 102/439; 86/1.1; 86/23; 86/43; 102/430; 102/431; 102/464

[58] Field of Search ..... 86/1.1, 23, 24, 43, 86/44; 102/395, 430, 431, 432, 439, 444, 445, 464–468, 476, 498, 529, 700

[56] References Cited

U.S. PATENT DOCUMENTS

| | | | |
|---|---|---|---|
| 2,083,665 | 6/1937 | Pihl et al. | 102/430 |
| 2,382,401 | 8/1945 | Dennis . | |
| 3,141,246 | 7/1964 | Boris . | |
| 3,217,587 | 11/1965 | Hegedus, Jr. . | |
| 3,706,279 | 12/1972 | Zimmerman | 102/431 |
| 4,211,168 | 7/1980 | Haep | 102/529 |
| 4,498,396 | 2/1985 | Berube | 102/529 |
| 4,887,534 | 12/1989 | Dickovich et al. | 102/439 |

FOREIGN PATENT DOCUMENTS

| | | | |
|---|---|---|---|
| 0049329 | 4/1982 | European Pat. Off. . | |
| 1578106 | 1/1971 | Fed. Rep. of Germany . | |
| 3837839 | 6/1989 | Fed. Rep. of Germany | 102/431 |
| 2407453 | 5/1979 | France . | |
| 2510249 | 1/1983 | France . | |

*Primary Examiner*—Harold J. Tudor
*Attorney, Agent, or Firm*—Spencer, Frank & Schneider

[57] ABSTRACT

A drive member for the projectile head of a large caliber, multi-purpose cartridge or a multi-purpose training cartridge, wherein a threaded connection is provided for the form-locking connection between the drive member and the projectile head. In order to give such multi-purpose cartridges or corresponding multi-purpose training cartridges a modular configuration, with their assembly taking place only at their location of use, the drive member is provided with radial bores that start at its outer edge or periphery at its end facing the projectile head. Before joining the projectile head and the drive member, a holding and clamping device is then introduced into these bores so as to securely hold the drive member when the respective projectile head is screwed to the drive member.

14 Claims, 4 Drawing Sheets

DRIVE MEMBER FOR A LARGE-CALIBER MULTI-PURPOSE CARTRIDGE AND USE OF SUCH A DRIVE MEMBER FOR THE PRODUCT OF DIFFERENT TYPES OF CARTRIDGES

BACKGROUND OF THE INVENTION

The present invention relates to a drive member for the projectile head of a large-caliber, multi-purpose cartridge or multi-purpose training cartridge of the type wherein the projectile head is fastened in a form-locking manner to the drive member by a threaded connection. The invention further relates to the use of such a drive member for the production of different types of cartridges.

Large-caliber multi-purpose cartridges, as they are fired, for example, from 120 mm tank cannons, have been known for a long time. They are composed of a caliber-sized shaped charge projectile and a propelling charge casing. The projectile has a shaft member which carries a stabilizing guide mechanism and is partially seated in a propelling charge casing filled with propelling charge powder. The portion of the projectile disposed outside of the propelling charge casing (the projectile head) is connected with the shaft member by a form-locking threaded connection, with an adhesive being employed to secure the projectile head against coming loose.

Also known are multi-purpose training cartridges which are provided with the same propelling charge casing and a corresponding shaft member and guide mechanism (the drive member) as the multi-purpose cartridges. As a projectile head, however, these training cartridges are provided with a simulated multi-purpose projectile. Such projectile heads thus have the same exterior shape and the same weight as the corresponding live projectiles. However, the training projectile heads do not contain any explosives, only an inert substance.

In the past, the multi-purpose cartridges as well as the corresponding multi-purpose training cartridges have been obtained only as complete cartridges furnished by the manufacturer. The manual screwing together of the drive member and the projectile head of the cartridges by the users themselves turned out to be relatively critical because screwing together these relatively heavy and unwieldy components may easily lead to damage to the cartridge casing, for example, due to inaccurate attachment of the projectile head to the drive member or tilting of the components relative to one another, etc.

Moreover, the storage of complete multi-purpose cartridges as well as multi-purpose training cartridges results in considerable storage costs. In addition, although training cartridges are used relatively frequently and therefore generally do not experience damaging ageing phenomena in their drive members, multi-purpose cartridges stored for the case of a crisis must be disassembled to a considerable extent after long periods of storage which again produces high costs.

SUMMARY OF THE INVENTION

It is therefore an object of the present invention to provide a drive member of the above-mentioned type which is suitable for the production of multi-purpose cartridges as well as for the production of corresponding multi-purpose training cartridges of the same caliber and with which it is possible to screw together the respective cartridges in a simple manner at their point of use (that is, by the user of the cartridges).

The above object generally is achieved according to the present invention by a drive member for a projectile head of a large caliber multi-purpose cartridge, which drive member comprises: a propelling charge casing; means disposed at a front end of the charge casing providing a threaded form-locking connection between the drive member and the projectile head of a multi-purpose cartridge; and, at least two bores which are directed radially inwardly from the outer circumference of the charge casing, which are provided at the front end of the charge casing, and which serve to fix a holding and clamping device for the drive member during the form-locking connection of the projectile head to the drive member.

According to the preferred embodiment of the invention, the means for providing a threaded connection includes a shaft member which is disposed in the charge casing and extends rearwardly from the front end of the charge casing, which is provided with a threaded axial bore in its outwardly directed end surface to receive a threaded pin disposed on a projectile head, and which is provided with a guide mechanism at its rear end, wherein the projectile head and the shaft member provided with the guide mechanism form a projectile to be fired.

The invention is thus essentially based on the concept of giving prior art multi-purpose cartridges or the corresponding training cartridges a modular configuration, with the cartridge being assembled only at the location of its use. The one module, namely the drive member, must then be provided with radial bores starting at its outer edge. Before joining together the projectile head and the drive member, a holding and clamping device is inserted into these bores so as to securely hold the drive member when the respective projectile head is screwed in.

For screwing together the cartridge it is of particular significance that the bores extend into the shaft member so that, after introduction of the holding and clamping device, the relatively thin projectile casing will not tear open particularly in conjunction with ammunition employing combustible casings.

The particular advantage of the present invention is that, aside from the lower storage costs, the drive members for the multi-purpose projectiles are always relatively new since these components are constantly replenished after being used in the training projectiles.

BRIEF DESCRIPTION OF THE DRAWINGS

Further details and advantages of the invention will now be described in greater detail with reference to embodiments thereof that are illustrated in the drawings, in which.

DETAILED DESCRIPTION OF THE PREFERRED EMBODIMENTS

Figure 2:
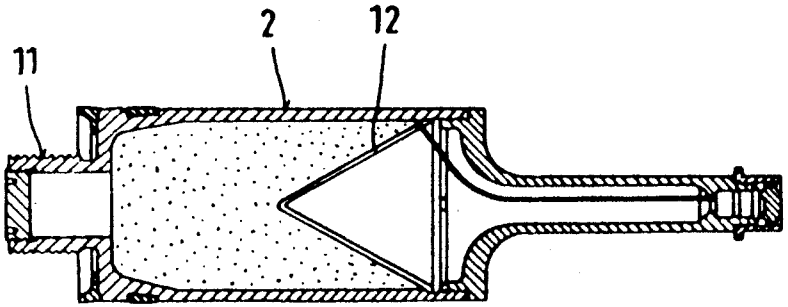
FIGS. 2 and 3 show two different type projectile heads that can be screwed to the drive member of FIG. 1.
Figure 3:
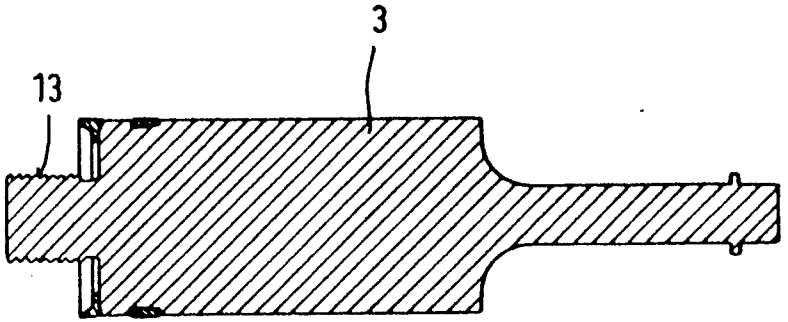
Figure 1:
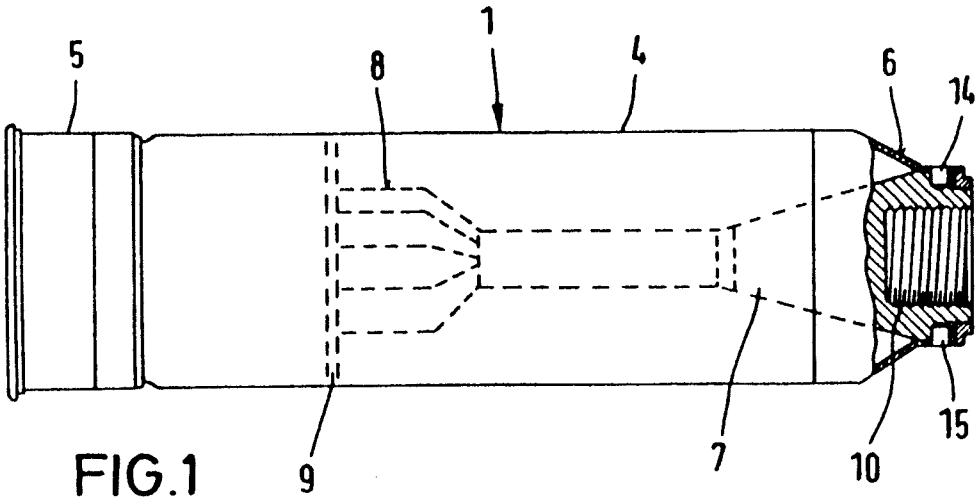
FIG. 1 is a schematic illustration of a drive member according to the invention which is provided with several radial bores.

In FIG. 1, the reference numeral 1 identifies a drive member which selectively can be screwed together with the projectile head 2 of a shaped-charge projectile with a charge liner 12 as shown in FIG. 2 or the projectile head 3 of a training projectile as shown in FIG. 3 to form a complete cartridge.

Drive member 1 is essentially composed of a propelling charge casing including a combustible casing jacket 4, a casing bottom 5 and a likewise combustible casing cover 6. A metal shaft member 7 accommodating a guide mechanism 8 at its rear end, i.e. the end facing away from the projectile head, is disposed in the interior of the cartridge casing. The rear end of shaft member 7 is fastened by way of a supporting disc 9 to the casing jacket 4 and the front region of shaft member 7 is connected with and closes the axial opening in the casing cover 6. A threaded blind axial bore 10 is provided in the end surface or portion of shaft member 7 facing the projectile head 2 or 3, and thus also in the front portion of drive member 1. This threaded bore 10 receives and forms a form-locking threaded connection with a rearwardly extending threaded pin 11 or 13 of respective projectile head 2 or 3 when the respective pin is screwed into the bore later at the location of the complete cartridge.

According to the present invention, several radial bores 14 to 17 are disposed in the forward portion of the drive member 1 (see also FIG. 5) to accommodate respective pins of a holding and clamping device. These radial bores 14–17, which preferably are symmetrically disposed about the periphery of the casing cover 6, extend from the outer circumference of drive member 1 through casing cover 6 into the solid shaft member 7 so that the holding and clamping device will be in form-locking contact, by way of these radial bores 14 to 17, with the shaft member 7.

Figure 4:
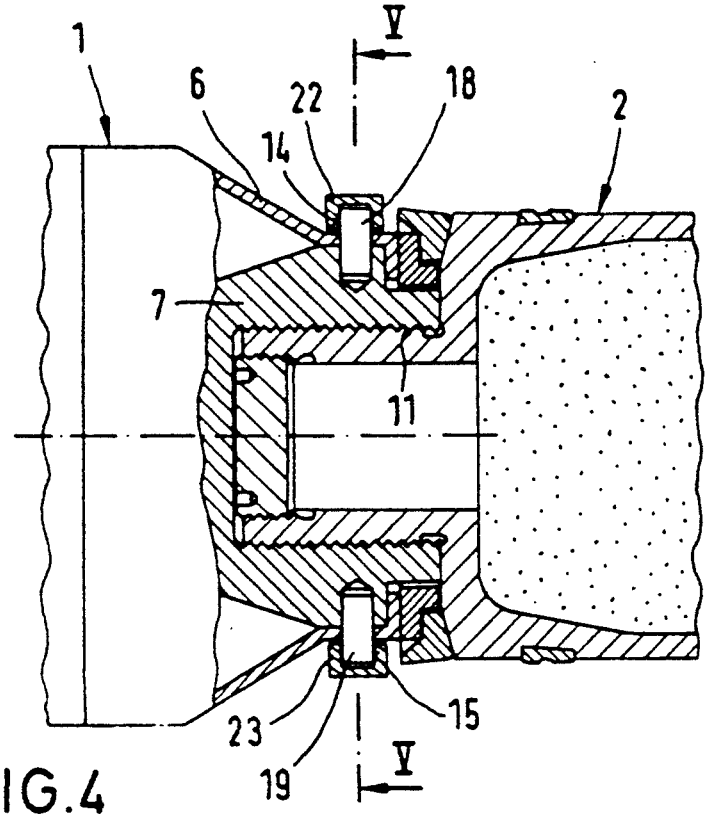
FIG. 4 is a partial longitudinal sectional view of the connection region between the drive member and the projectile head, showing parts of a holding and clamping device.
Figure 5:
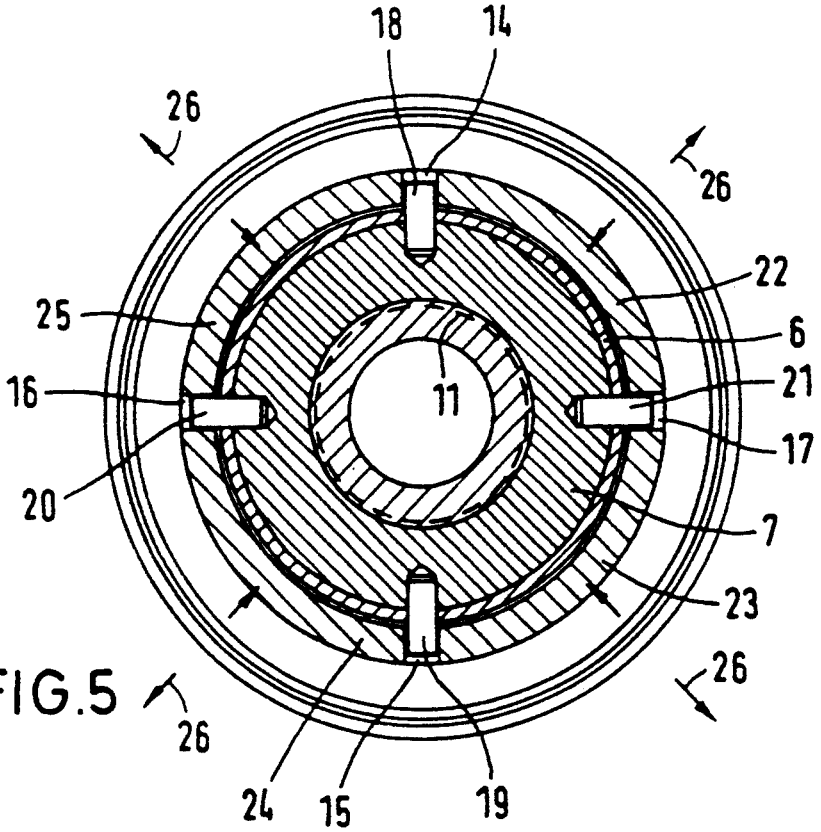
FIG. 5 is a cross-sectional view of the connection region along the section line marked V—V in FIG. 4.

FIG. 4 is a sectional view of a portion of a cartridge in which drive member 1 is connected with a projectile head 2 and in which the holding and clamping device still engages into the bores 14 to 17. As can be seen in FIGS. 4 and 5, the holding and clamping device is here essentially composed of pins 18 to 21 which, on the one hand, are pushed into the bores 14–17 respectively, and down into shaft member 7 and, on the other hand, project on the outside beyond the circumference of the casing cover 6. As can be seen in FIG. 5, the holding and clamping device is provided with clamping jaws 22 to 25 which can be radially displaced and which extend on the circumference of the cover 6 at least between the projections of the pins 18 to 21. The direction of movement of clamping jaws 22 to 25 is indicated by arrows 26.

In order to screw together drive member 1 and projectile head 2, the pins 18 to 21 are initially pushed into the respective bores 14 to 17, for example, with the aid of a non-illustrated gripper member that is a part of the holding and clamping device, and then clamping jaws 22 to 25 are pushed, again with this device, onto the adjacent circumference of the casing cover 6. Thereafter, projectile head 2 can be screwed manually onto drive member 1, with an adhesive serving as a protection against the projectile head 2 coming loose. After removal of the holding device, the bores 14–17 may be sealed, for example, by means of a plastic plug.

Figure 6:
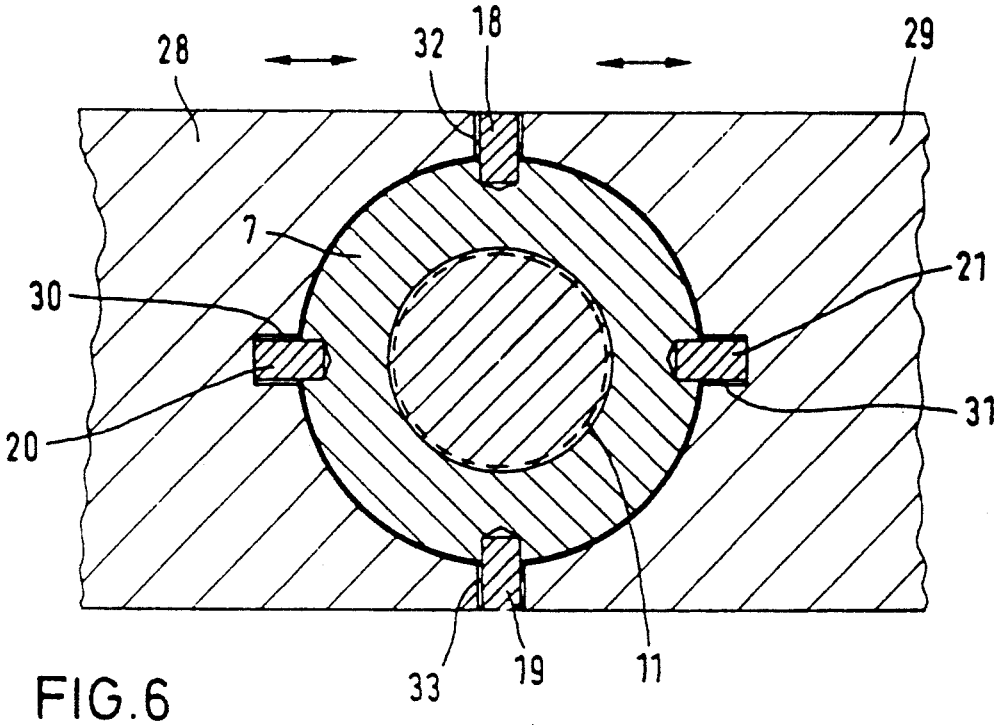
FIGS. 6 and 7 are schematic cross-sectional views showing two different arrangements of the clamping jaws of the holding and clamping device.
Figure 7:
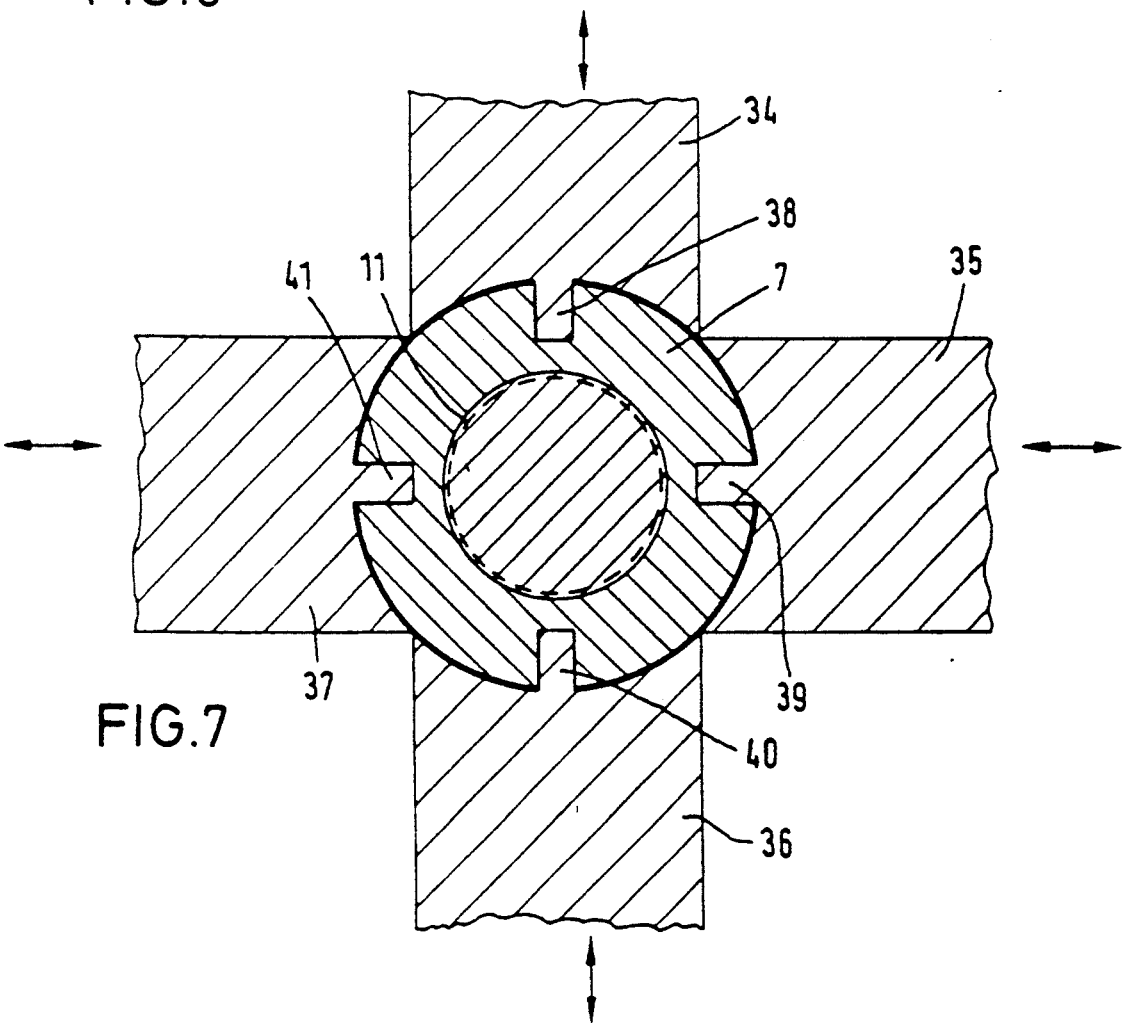

FIGS. 6 and 7 depict two further particularly advantageous clamping jaw arrangements of the holding and clamping device required to hold drive member 1. For reasons of clarity, only the shaft member 7 and the threaded pin 11 of the projectile head of the multi-purpose cartridge are indicated in these figures.

In the embodiment shown in FIG. 6, pins 18 to 21 are again employed. But, in contrast to FIGS. 4 and 5, in this embodiment only two clamping jaws 28 and 29 are employed instead of four. Clamping jaws 28 and 29 are provided, on the one hand, with bores 30 and 31, into which the portions of pins 20 and 21 that project beyond the surface of the casing cover 6 engage in a form-locking manner. On the other hand, at their interface clamping jaws 28 and 29, which are adjacent to one another on the circumference, are provided with recesses 32 and 33 which are selected such that, after clamping jaws 28 and 29 have been pressed against casing cover 6, a form-locking connection exists between clamping jaws 28 and 29 and pins 18 and 19 which are provided in the region of recesses 32 and 33 and project on the outside beyond the surface of casing cover 6. Clamping jaws 28 and 29 are arranged so as to be movable in the directions characterized by arrows.

In the embodiment shown in FIG. 7, again four clamping jaws 34 to 37 are employed. However, in this embodiment, pins 38 to 41 are components of the respective clamping jaws 34 to 37 so that compression of clamping jaws 34 to 37 directly produces a form-locking connection with bores 14 to 17.

Figure 8:
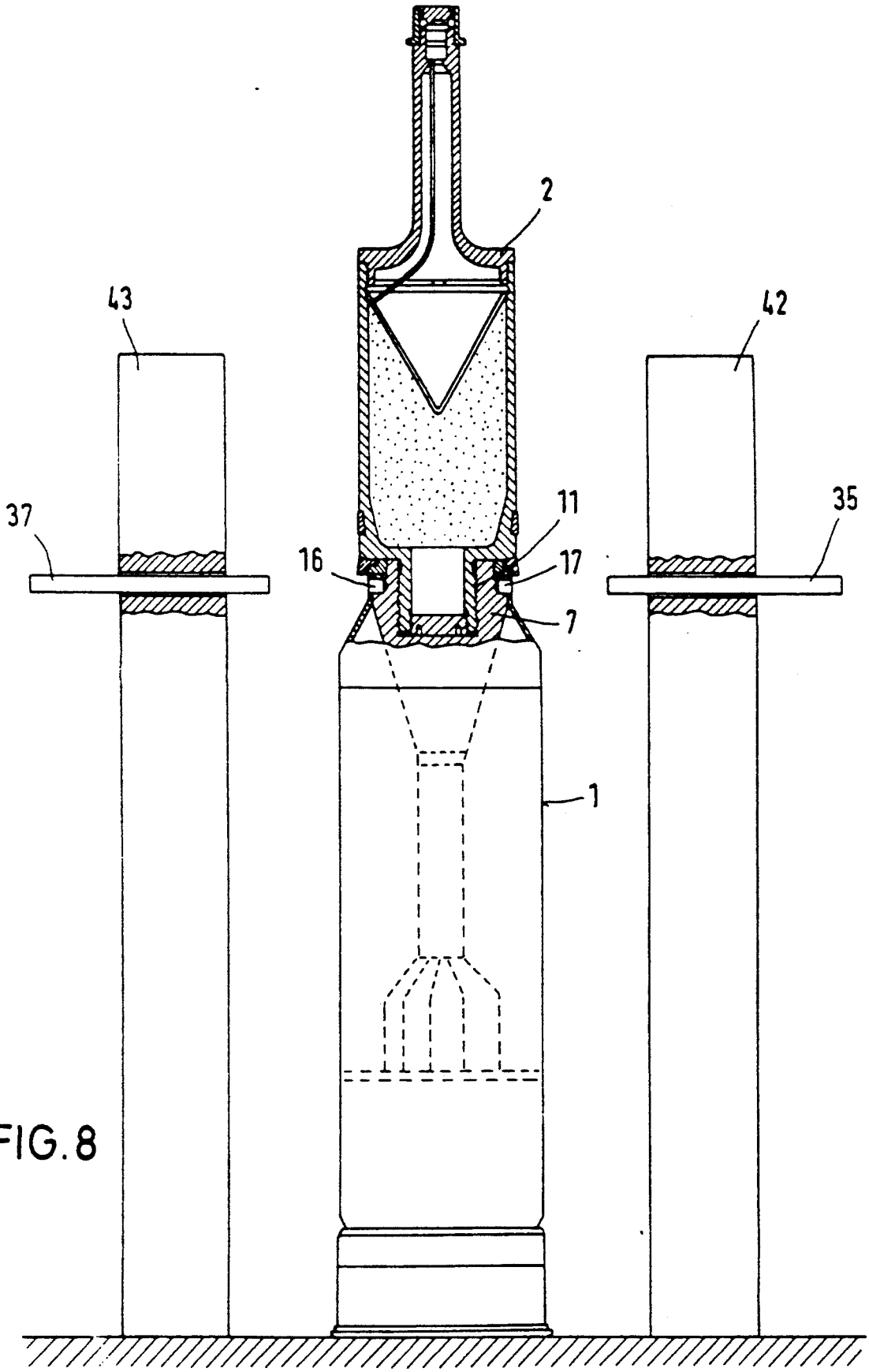
FIG. 8 is a schematic elevation view of the multipurpose cartridge of FIG. 1 relative to a holding and clamping device in the opened state.

FIG. 8 is an elevational view of a multi-purpose complete cartridge including a drive member 1 and a projectile head 2 disposed within a clamping device. Clamping jaw guide members 42 and 43, respectively, are disposed on each side of the cartridge. Clamping jaws 35 and 37 are arranged to be movable in these guide members 42 and 43 and can be pressed out of the illustrated open position and against shaft members 7. The same also applies for clamping jaws 22 to 25; 28 and 29; 34 and 36. The drive (not shown) for clamping jaws 35 and 37 may be disposed, for example, in clamping jaw guide members 42 and 43. The radial bores 14–17 and the clamping arrangement additionally may be utilized in a beneficial manner to disassemble a complete multi-purpose cartridge if such should become necessary.

It will be understood that the above description of the present invention is susceptible to various modifications, changes and adaptations, and the same are intended to be comprehended within the meaning and range of equivalents of the appended claims.

What is claimed is:

1. A drive member for a projectile head of a large-caliber multi-purpose live cartridge or multi-purpose training cartridge, said drive member comprising: a propelling charge casing; means disposed at a front end of said charge casing for providing a threaded form-locking connection between the drive member and a projectile head of a multi-purpose cartridge; and, at least two bores, which are directed radially inwardly from an outer circumference of said charge casing, which extend into said means for providing a threaded form-locking connection, and which serve to fix a holding and clamping device for the drive member during the form-locking connection of the projectile head to the drive member, provided at said front end of said charge casing.

2. A drive member according to claim 1, wherein said means for providing a threaded form-locking connection includes a member disposed at said front end of said charge casing and provided, in an outwardly directed end surface, with a threaded axial bore for receiving a threaded pin disposed on a projectile head and facing the drive member, whereby the projectile head can be connected to the drive member by screwing the pin of the projectile head into said threaded bore.

3. A drive member according to claim 2, wherein said member with said axial threaded bore is a shaft member which is disposed in said charge casing of said drive member and which is provided with a guide mechanism at its rear end, whereby the projectile head and said shaft member provided with said guide mechanism forms a projectile to be fired.

4. A drive member according to claim 3, wherein said radial bores extend into said shaft member.

5. A drive member according to claim 1, wherein said radial bores are distributed about the periphery of said drive member.

6. A drive member according to claim 5, wherein said radial bores are symmetrically distributed about said periphery.

7. A method for the production of a large-caliber, multi-purpose cartridge composed of a drive member which is fastened to a projectile head comprising: initially separately storing (1) a drive member comprising a propelling charge casing, means disposed at a front end of said charge casing for providing a threaded form-locking connection between said drive member and the projectile head of a multi-purpose cartridge, and at least two radial bores, which are directed radially inwardly from an outer circumference of said charge casing and which extend into said means for providing a form-locking connection, provided at said front end of said charge casing, and (2) at least one projectile head which is connectable to said drive member via said threaded connection, at their location of use; and connecting a drive member with a selected projectile head, while the drive member is held in a holding and clamping device engaged in said radial bores, only if there is a concrete demand for such ammunition.

8. A method according to claim 7, for the production of live combat ammunition wherein the projectile head is a shaped charge warhead.

9. A method according to claim 7, for the production of training ammunition wherein the projectile head is a training head.

10. A large caliber multi-purpose cartridge comprising a multi-purpose projectile head threadingly connected to a drive member comprising a propelling charge casing, means disposed at a front end of said charge casing for providing a threaded form-locking connection between said drive member and the projectile head of a multi-purpose cartridge, and at least two radial bores, which are directed radially inwardly from an outer circumference of said charge casing and which extend into said means for providing a form-locking connection, provided at said front end of said charge casing.

11. A large caliber multipurpose cartridge according to claim 10 wherein: said drive member further includes a shaft member which is disposed in said charge casing, which has a front region connected to said front end of said charge casing, and which is provided with a guide mechanism at its rear end; said means for providing a threaded form-locking connection includes a threaded axial bore disposed in a front end surface of said shaft member; and said projectile head has an axial threaded pin which is disposed at a rear surface of said projectile head facing said drive member and which is threadingly engaged in said bore.

12. A cartridge according to claim 11, wherein said radial bores are distributed about a periphery of said charge casing and extend into said shaft member.

13. A cartridge according to claim 11, wherein said projectile head is a shaped charge warhead.

14. A cartridge according to claim 10, wherein said projectile head is a training head.

* * * * *